United States Patent [19]

Williams

[11] 4,126,975

[45] Nov. 28, 1978

[54] DOOR JAMB

[76] Inventor: Larry L. Williams, 8745 Sophia St., Sepulveda, Calif. 91343

[21] Appl. No.: 761,546

[22] Filed: Jan. 21, 1977

[51] Int. Cl.[2] ..... E06B 1/20

[52] U.S. Cl. ..... 52/211; 49/505

[58] Field of Search ..... 52/211–217; 49/504, 505

[56] References Cited

U.S. PATENT DOCUMENTS

| | | | |
|---|---|---|---|
| 2,742,117 | 4/1956 | Tolman | 52/213 X |
| 3,364,624 | 1/1968 | Davis | 52/213 |
| 3,654,734 | 4/1972 | Lehman | 52/213 X |
| 3,788,019 | 1/1974 | Kiselewski | 52/217 |

FOREIGN PATENT DOCUMENTS

| | | | |
|---|---|---|---|
| 2,312,778 | 9/1973 | Fed. Rep. of Germany | 52/211 |
| 2,436,055 | 2/1976 | Fed. Rep. of Germany | 52/211 |
| 1,311,688 | 10/1962 | France | 52/211 |

*Primary Examiner*—J. Karl Bell

*Attorney, Agent, or Firm*—Roger A. Marrs

[57] ABSTRACT

A door jamb is disclosed herein of two piece construction including overlapping portions secured together by a screw and clamp portions engageable with the opposite sides of a door frame. The overlapping portions operate as a movable assembly which is spring biased to forcibly urge the clamp portions into secure engagement with the frame.

1 Claim, 5 Drawing Figures

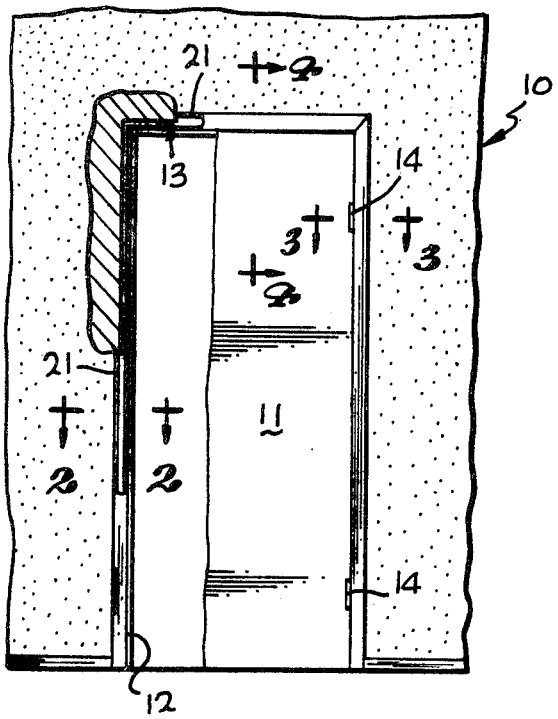
Fig. 1
Fig. 3
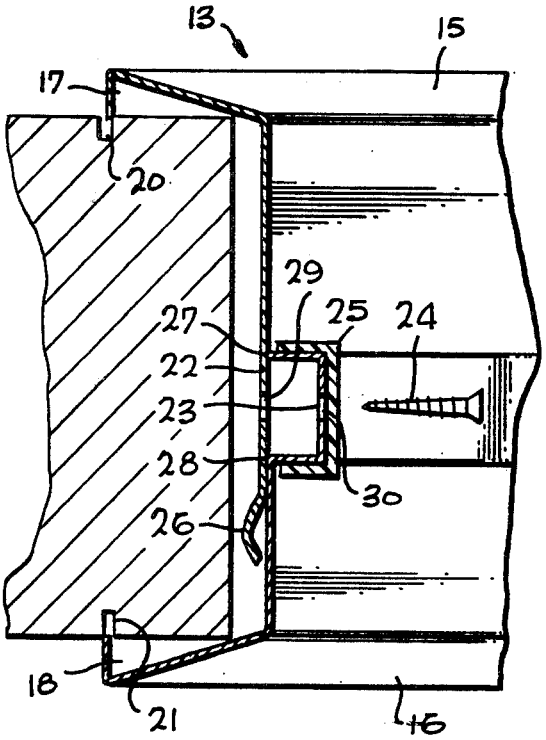
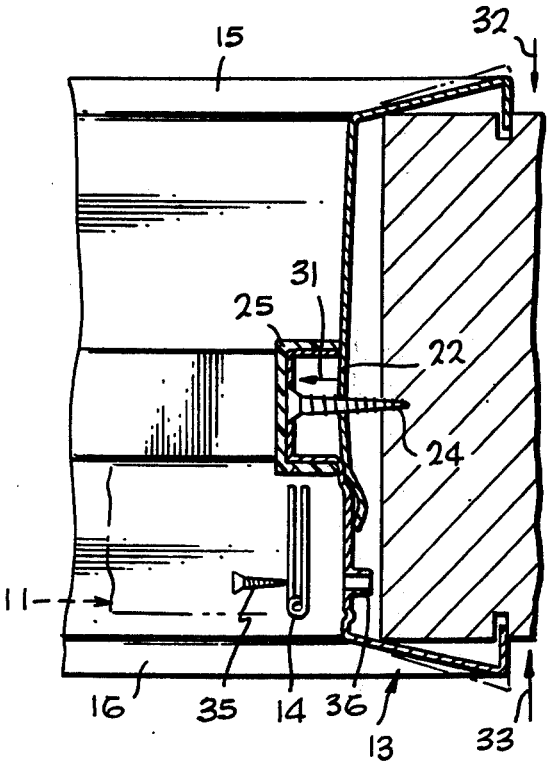
Fig. 2

DOOR JAMB

BACKGROUND OF THE INVENTION

1. Field of the Invention

This invention relates to building constructions in general and more particularly to a novel frame or casing construction for secure mounting in wall openings to support and cooperate with doors and windows occupying the openings.

2. Brief Description of the Prior Art

Heretofore, the information and construction of frames and casings for doors and windows has required the use of carpenters of the highest skill and rate of pay. Further, the construction of casings such as openings in walls did not always result in properly hung doors and windows regardless of the skill of the artisan.

With these considerations in mind, it is an object of the present invention to provide a pre-fabricated casing assembly for wall openings which is readily adapted to the wall opening and which does not require the use of skilled workmen to install.

Another object of the present invention is to provide a novel pre-fabricated casing assembly for wall openings which may be installed with the component members thereof disposed in true vertical or horizontal potitions regardless of the possible departure from plumb or level lines of the edge facings of the openings.

A further object of the present invention is to provide a novel pre-fabricated casing assembly for wall openings which is so constructed and arranged that installation is achieved by a positive clamping action against the wall faces at each side of the opening.

A further object of the present invention is to provide a novel door jamb which is of a two piece construction having an overlapping portion readily spring loaded so as to bias clamping portions into the door frame defining the opening.

In one form of the invention, the door jamb includes the two piece construction having overlapping portions which are secured together by a fastener means. Clamping portions are engageable with opposite sides of the door frame and are normally biased into secure engagement with the opposite sides of the door frame by means of the spring loading of the overlapped portions in cooperation with the fastening means.

Therefore, a long standing need is present to provide a door jamb which has a positive clamping action and a spring biasing means urging the clamp portions into engagement with the door jamb.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a front elevational view of the novel door jamb installed in a typical door opening of a building;

FIG. 2 is an enlarged transverse sectional view of the novel door jamb taken in the direction of arrow 2—2 of FIG. 1;

FIG. 3 is a view similar to the view of FIG. 2 showing the installation of the door jamb including door hardware as shown in FIG. 1 as taken in the direction of arrows 3—3 thereof;

DESCRIPTION OF THE PREFERRED EMBODIMENT

Figure 4:
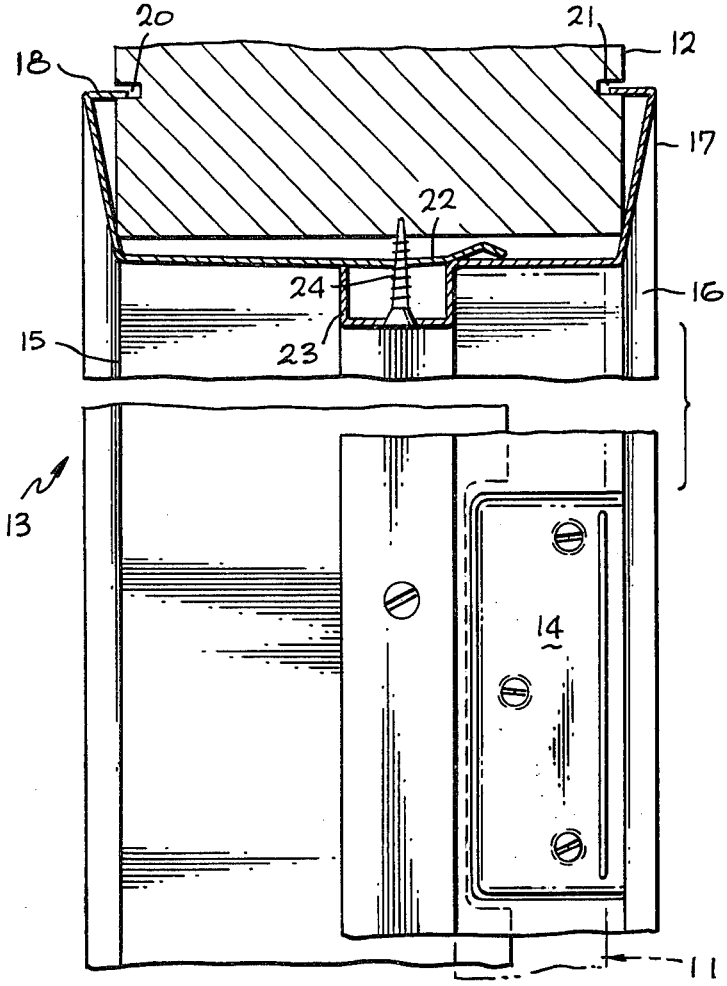
FIG. 4 is a cross-sectional view of the installed door jamb and door hardware as taken in the direction of arrows 4—4 of FIG. 1.

Referring to FIG. 1, a building is illustrated by numeral 10 which includes a door 11 occupying an opening defined by the opposing surfaces of a U shaped frame 12. The door 11 is mounted on a door jamb 13 by means of a conventional hinge 14. Preferably, the frame 12 is composed of wood and the door jamb 13 is composed of metal. The subject matter of the present invention is represented by the numeral 13 and is indicated in the general direction of arrow 13 in FIGS. 2 and 3.

Referring to FIG. 2, the door jamb 13 is composed of a two piece construction having numerals 15 and 16 respectively. Each of the pieces 15 and 16 includes a clamp portion 17 and 18 which represent inwardly disposed edge marginal regions which are intended to be pressed into the opposite sides of the wooden door frame 12. Preferably, the frame 12 is provided with grooves 20 and 21 for receiving the clamps 17 and 18 respectively.

The pieces 15 and 16 further include a pair of overlapping sections which are represented by numerals 22 and 23 which form a compression mechanism in cooperation with a fastening means such as screw 24. A cap 25 covers the mechanism when assembled. The overlapping portions or sections 22 and 23 are arranged so that section 22 includes a semicircular bead 26 which is adjacent the face of the frame 12 and this bead is overlapped by section 23 which includes a U shaped member having a pair of pressure points 27 and 28 engageable with the section 22. A hole 29 engages with the threads of the screw 24 as it passes through a registered hole 30 in the section 23 so that the section 23 is pulled towards the section 22 and the pressure points 27 and 28 resist this action. The action is further increased by means of the screw 24 engaging into the frame 12 as shown in FIG. 3.

Referring now in detail to FIG. 3, it can be seen that when the screw 24 has been fully turned so that its countersunk head rests in hole 30, a load is placed on the section 22 drawing it toward the section 23 in the direction of arrow 31. Also, it is to be understood that this compressive action draws the clamps 17 and 18 in the direction of arrows 32 and 33 so that the opposite sides of the frame 12 are suitably engaged and secured. The cap 25 is then placed over the section 23 to protect the screws or fastening means 24.

FIG. 3 further illustrates the mounting of the hinge 14 onto the door jamb by means of a screw such as screw 35 insertably disposed and threadably engaged into a mating receptacle 36. By these means, the door jamb 13 is secured to the frame 12 and the door 11 is suitably mounted onto the jamb by means of the hinge 14.

Referring now to FIG. 4, it can be seen that the jamb is suitably secured to the frame 12 by means of the compression mechanism comprising the overlapping sections 22 and 23 in cooperation with the mounting screws 24. The clamping portions 17 and 18 are readily engaged with the slots 20 and 21 and the jamb is fixedly secured to the frame. The door is mounted by the hinge 14 and no further installation or adjustment is necessary or required.

Figure 5:
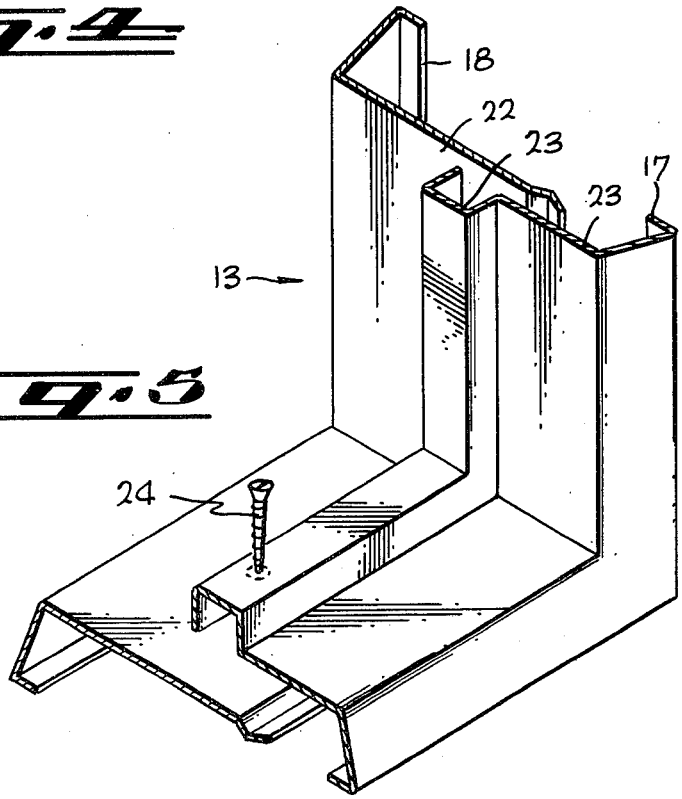
FIG. 5 is a front perspective view of the novel door jamb preparatory to installation on a door frame.

In FIG. 5, an exploded perspective view of the novel door jamb of the present invention is illustrated wherein it can be seen that the overlapped portions 22 and 23 form a holding mechanism when the screw 24 is inserted through the registered holes 29 and 30 respectively.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A metal jamb construction for securement onto a frame having frame surfaces defining an opening through a wall in a building, comprising the combination of:

a first piece having a clamping portion engageable with one side of said frame and a joining section extending into said opening from said one side generally parallel to said frame surfaces, said joining section terminating in a semicircular bead, the concave side of which faces said frame surfaces;

a second piece having a clamping portion engageable with the other side of said frame and a joining section extending into said opening from said other side and having a main portion generally parallel to said frame surfaces and so positioned that said joining section of said first piece lies between said joining section of said second piece and said frame surfaces, said joining section of said second piece including a box-like portion formed of a first wall portion extending perpendicularly from said main portion into said opening, a second wall portion extending from said first wall portion parallel to said main portion and a third wall portion extending from said second wall portion parallel to said first wall portion back to said joining section of said first piece with the end of said third wall portion abutting against said joining section of said first piece;

said joining sections constituting compression loaded, spring biasing means for forcibly urging said clamping portions into secure engagement with said frame;

said biasing means including a fastener means engageable between said joining sections placing a compressive load therebetween and including said box-like portion of said joining section of said second piece and said semi-circular bead carried on said first piece;

said fastener means being a screw operably passing through said second wall portion of said box-like portion into said joining section of said first piece, whereby pressure points are established on said joining section of said first piece where contacted by a corner formed by said first wall portion and said main portion and said abutting end of said third wall portion;

a selected one of said pieces including shaped depressions to receive a hinge;

said clamping portions including outwardly depending legs having inwardly and opposing foot elements engageable with said frame;

the opposite sides of said frame including a groove to insertably receive a guide said associated and respective foot element; and said box-like portion constituting a spacer and a cap covering said box-like portion in snap lock relationship therewith.

* * * * *